US007905170B1

(12) United States Patent
Brittingham et al.

(10) Patent No.: US 7,905,170 B1
(45) Date of Patent: Mar. 15, 2011

(54) FLASH SUPPRESSOR

(75) Inventors: Kevin Tyson Brittingham, Norcross, GA (US); Robert Silvers, Marshfield, MA (US)

(73) Assignee: Advanced Armament Corp., LLC, Madison, NC (US)

( * ) Notice: Subject to any disclaimer, the term of this patent is extended or adjusted under 35 U.S.C. 154(b) by 705 days.

(21) Appl. No.: 11/879,547

(22) Filed: Jul. 18, 2007

(51) Int. Cl.
*F41A 21/00* (2006.01)

(52) U.S. Cl. ..... 89/14.2; 89/14.4

(58) Field of Classification Search ..... 89/14.05–14.6; 42/79

See application file for complete search history.

(56) References Cited

U.S. PATENT DOCUMENTS

| | | | | |
|---|---|---|---|---|
| 2,870,679 | A * | 1/1959 | Collins | 89/14.2 |
| 2,900,875 | A * | 8/1959 | Fergus et al. | 89/14.3 |
| 4,570,529 | A * | 2/1986 | A'Costa | 89/14.2 |
| 4,893,544 | A * | 1/1990 | Hawley et al. | 89/14.2 |
| 5,092,223 | A * | 3/1992 | Hudson | 89/14.2 |
| 5,596,161 | A | 1/1997 | Sommers | |
| 5,773,746 | A * | 6/1998 | Vaden | 89/14.4 |
| 6,837,139 | B2 * | 1/2005 | Meyers | 89/14.2 |
| 6,948,415 | B2 * | 9/2005 | Matthews et al. | 89/14.4 |
| 7,302,774 | B2 | 12/2007 | Meyers | |
| 2007/0095198 | A1 * | 5/2007 | Dater et al. | 89/14.2 |

* cited by examiner

*Primary Examiner* — Michael Carone
*Assistant Examiner* — Gabriel J Klein
(74) *Attorney, Agent, or Firm* — Merchant & Gould, P.C.

(57) ABSTRACT

An improved flash suppressor and silencer mount. The use of tapered tines allows for the easy removal of a noise suppressor from the flash suppressor even after extended use. Due to the construction of the flash suppressor and through proper material selection the tines will not warp or break even after being exposed to temperatures in excess of 1100 degrees. Through the use of angled concave transition portions this device is a superb stand alone flash suppressor.

11 Claims, 1 Drawing Sheet

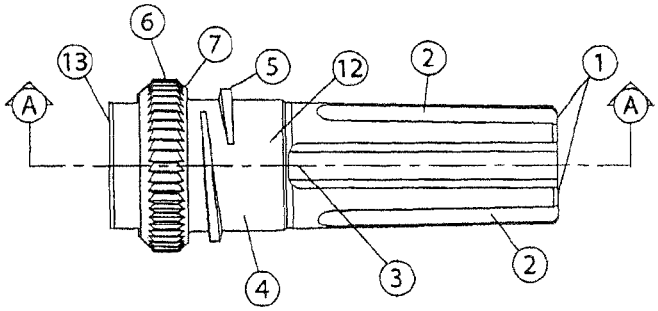
FIGURE 1
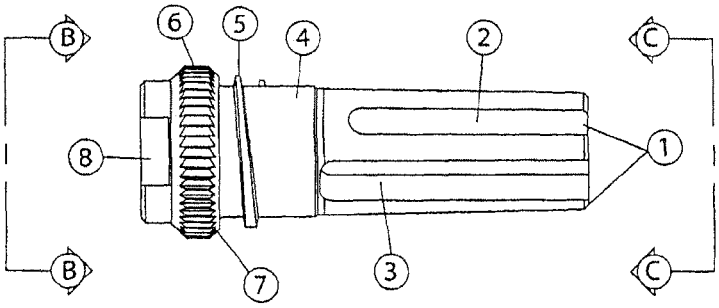
FIGURE 2
FIGURE 3
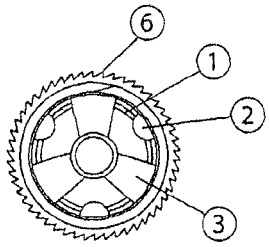
VIEW C-C
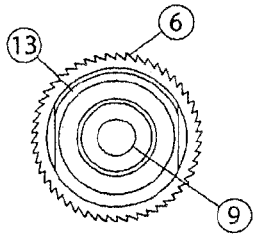
VIEW B-B
FIGURE 4
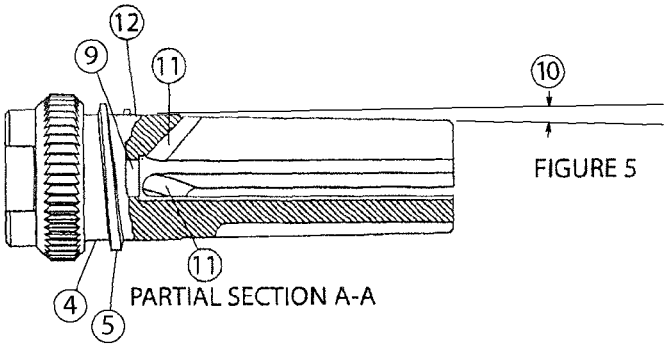
PARTIAL SECTION A-A
FIGURE 5

FLASH SUPPRESSOR

BACKGROUND OF THE INVENTION

1. Field of Invention

This invention generally relates to firearms muzzle devices, specifically to devices commonly referred to as flash suppressors/flash hiders which are affixed to the muzzle of a firearm barrel for the purpose of reducing flash associated with the discharge of the host firearm.

2. Prior Art

Various systems exist for reducing the muzzle flash of a firearm with it has been discharged. Previous designs provide a combination of features which culminated in a system for reducing the muzzle flash of a firearm to various degrees. BE Meyers four tine design (as patented in Meyers U.S. Pat. No. 6,837,139 and Meyers U.S. Pat. No. 7,302,774) and the Smith Enterprises Vortex flash suppressor (as patented in Sommers U.S. Pat. No. 5,596,161) are two popular designs currently available. The two aforementioned designs fail to provide several needed features necessary and desirable for today's firearms.

Muzzle flash occurs as a result of the contact of the propellant with the air at the muzzle. The propellant gas mixture, containing traces of unburned powder, remains extremely hot at the end of the barrel. Oxygen in the surrounding air combines with the hot gas to enable combustion of the residual chemicals, resulting in a visible flash of light just beyond the end of the barrel. Muzzle flash is undesirable because it gives away the location of a shooter at night or under other low ambient light conditions. The flash suppressor of the current invention provides superior flash reduction over the Smith Enterprises Vortex design and BE Meyers designs. Through the use of three tapered prongs and proprietary cuts shown and described in the following text and drawings the flash suppressor provides superior flash reduction. The use of noise suppressors is steadily growing within civilian, law enforcement, and military circles. The need for an effective flash suppressor which will work with a noise suppressor cannot be ignored. The flash suppressor not only provides superior flash reduction over other available designs it is also superior to other designs for use with a noise suppressor. Current flash suppressor designs utilizing open front tines are prone to expansion when a noise suppressor is mounted during prolong firing schedules. This expansion is the result of substantial pressures and heat exposure and metal fatigue. An expansion of the flash suppressor tines by as little as 2 or 3 thousandths of an inch can render the noise suppressor nearly impossible to remove from the host firearm.

OBJECTS AND ADVANTAGES

Accordingly, several objects and advantages of the present invention are (a) To provide superior flash hider/flash suppression capability over existing designs; (b) To provide a flash hider which is structurally superior to other effective flash suppressor designs for the potential use of a noise suppressor by providing tapered tines, and three tines; and (c) To provide a flash suppressor which is superior to other designs for use with a noise suppressor, particularly a design which allows the end user to remove the associated noise suppressor after prolonged firing by tapering the flash suppressor tines thereby reducing unnecessary friction between the flash suppressor and noise suppressor bearing surfaces.

Still further objects and advantages will become apparent from a consideration of the ensuing description and drawings.

SUMMARY

The present invention provides an apparatus which is an effective flash hider/flash suppressor. Flash is the result of expanding, and combusting gases exiting the muzzle of a host firearm when discharged.

The apparatus may also be used as a mount for a noise suppressor where it excels due to the selected material, and geometry of its tines. The present invention utilizes tapered tines which provide several advantages over straight tines. The heat and pressure from expanding gasses which are the result of discharging a firearm may warp or cause the tines of a flash suppressor to expand. This expansion is a concern due the flash suppressor's location on the muzzle of a firearm. Carbon, copper, and lead may accumulate on the external surface of the flash suppressor when used in conjunction with a noise suppressor making the noise suppressor nearly impossible to remove by hand. Adding a taper to the tines of a flash hider manufactured with heat resistant alloys reduces the chances of tine expansion and reduces the contact between the flash suppressor and noise suppressor mount. Reducing contact between the noise suppressor mount and flash suppressor renders the carbon, lead and copper build up from even the most extreme firing schedules irrelevant.

In general terms, the invention provides external apparatus for attachment to a firearm including a barrel having a longitudinal axis, comprising the combinations of: a fixture adapted to be attached to the muzzle of the barrel coaxially there with annular threads, internally coaxial to said bore; and external taper on tines where each tine is thickest near bearing surface and tapers to the open tip of the flash hider. 17-4 heat treated stainless steel is the material of choice for the proposed device.

More specifically, a preferred embodiment according to the invention provides a flash suppressor apparatus which may or may not serve as a fixture for a noise suppressor comprising the combination of; a bearing surface for a noise suppressor which is present on the proposed apparatus in all forms, a taper of the tines which allows for the easy removal of an installed noise suppressor, and three tines equally spaced around the annular surface of the flash suppressor.

In a preferred embodiment of the apparatus, three tines, a bearing surface, tapering tines, single lead acme thread, fifty serrated teeth and annular ridge are provided on the barrel by providing a flash suppressor with three tines equally spaced about the annular surface of the flash suppressor, where each tine will taper from the bearing surface, and tines will be open in the front.

The annular ridge, external single lead acme thread, and 50 angled and serrated teeth present on the preferred embodiment are not part of what this apparatus claims as novel. These features are shown since the proposed apparatus will primarily be used in conjunction with a noise suppressor; these features are the subject of copending U.S. Pat. No. 7,661,349. Apparatus comprises a flash suppressor.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

FIG. 1 shows a horizontal side view of the new Flash suppressor;

FIG. 2 shows a top horizontal side view of the Flash suppressor;

FIG. 3 shows a front view of the Flash suppressor;

FIG. 4 shows a rear view of the Flash suppressor;

FIG. 5 shows an internal, horizontal side view of the Flash suppressor;

DETAILED DESCRIPTION OF THE PREFERRED EMBODIMENT

Heat treatable stainless steel is used to construct the flash suppressor. Certain alloys of stainless steel may be heat treated for additional strength. Properly selected stainless steel alloys, when used in the manufacture of firearm parts, can maintain machined or cast structure under temperatures up to 1200 degrees, which is an important consideration due to the firing schedules modern firearms are often subjected to.

The flash suppressor is manufactured using a lathe and mill to complete both circular and plunge cuts which are necessary for its construction.

FIGS. 1-5 show the preferred embodiment of the present invention. It depicts a flash suppressor 12 configured for use with standard United States military weaponry, particularly the AR-15 and M-16 firearms. These firearms have a standard bore of .223 caliber (5.56 mm). Such firearms have a barrel with a conventional male threaded extension. Flash suppressor 12 generally includes a cylindrical socket 13 which has a threaded recess for receiving the extension of the gun barrel.

The flash suppressor 12 is a cylindrical barrel extension approximately 3" inches long, made of 17-4 stainless steel which is heat treated to increase the hardness. Other grades of material (e.g., 4140 steel) would be acceptable for civilian use.

Cylindrical socket 13 includes an axial central bore 9 of a diameter slightly larger than the bore of the firearm to which the flash suppressor is attached. The diameter of an exit chamber defined by the central bore 9 is large enough so that the exiting projectile will not touch any portion of the suppressor 12 as it proceeds. The body of the flash suppressor 12 surrounding the exit chamber has three equally-spaced 45 degree angled cuts or transition portions 11 running the length of exit chamber 9 and angled forward toward three slots 3 defined in a forward portion of the flash suppressor 12. Transition portions 11 have radius ends at their proximal ends and are open at their distal ends, thereby defining a concave profile. As may be seen on FIG. 5, the transition portions 11 are slightly offset from tines 1 defined between adjacent slots 3.

In the .223 caliber (5.56 mm) embodiment, the transition portions 11 are at 45 degrees clockwise from the centerline with a radius curve at their proximal ends. If for some reason the rifling of the gun barrel were counterclockwise, the flutes would be angled and the offset would be set counterclockwise.

The military embodiment also includes a single lead acme 5 thread for threadedly attaching a noise suppressor. It also includes an annular shoulder 7 and 50 angled teeth 6 which interface with a noise suppressor locking mechanism. A forward bearing surface 4 is provided in a rear portion of the flash suppressor 12 to help align a noise suppressor about the flash suppressor 12.

A one degree taper 10 is provided on tines 1. By providing a gradual taper the distance between the bearing surface of a noise suppressor and the bearing surface 4 and outside diameter of the tines 1 increases. This gradual increase in spacer will prevent copper and carbon build up from inhibiting the removal of a noise suppressor.

In operation, the flash suppressor 12 is simply screwed onto the end of the barrel extension until it stops. Wrench flats 8 are provided to help facilitate removably securing the flash suppressor 12. When the weapon is fired, the exiting spinning bullet proceeds through through central bore 9. The transition portions 11 prevent contact of the propellant with the air at the muzzle thus reducing or eliminating the visible flash signature.

As used herein, the word "front" or "forward" corresponds to the firing direction of the firearm (i.e., to the right as shown in FIGS. 1 and 2); "rear" or "rearward" or "back" corresponds to the direction opposite the firing direction of the firearm (i.e., to the left as shown in FIGS. 1 and 2); "longitudinal" means the direction along or parallel to the longitudinal axis a of the barrel of the firearm or of the flash suppressor 1; and "transverse" means a direction perpendicular to the longitudinal direction.

CONCLUSION, RAMIFICATIONS, AND SCOPE

Accordingly the reader will see that, according to the invention, I have provided an apparatus which is superior to other designs in regards to flash suppression capability and structural durability when the flash suppressor 12 is used in conjunction with a noise suppressor. I have also afforded any user of my invention the ability to use a night vision device while firing a weapon with my flash suppressor 12 in place. Further is can be seen that geometry of the flash suppressor tines, with the appropriately selected material creates a flash suppressor apparatus which is superior to others when used in conjunction with a noise suppressor. Tapering the tines will reduce unnecessary friction between the flash suppressor 12 and the internal bearing surface of the associated noise suppressor allowing the end user to more easily remove the noise suppressor after prolonged firing schedules.

Creating internal geometry within the flash suppressor 12 which renders it an effective flash suppressor while at the same time maintaining the structural durability of the design for use with a noise suppressor makes this flash suppressor 12 superior to others in its class. The durability of the flash suppressor tines while still maintaining internal geometry which effectively displaces unburned powder to reduce muzzle flash is particularly unique to this design.

While my above drawings and description contain many specificities, these should not be construed as limitations on the scope of the invention, but rather as an exemplification of one preferred embodiment thereof. For example the flash suppressor 12 presented above can be used as a standard flash hider by omitting the proprietary mounting system used by Advanced Armament Corp. The flash suppressor 12 could be machined directly on to the barrel of a host firearm.

Accordingly, the scope of the invention should be determined not by the embodiments illustrated, but by the appended claims and their legal equivalents.

The invention claimed is:

1. A flash suppressor for use with a firearm having a barrel, the flash suppressor comprising:

an elongated body with a forward portion and a rearward portion collectively defining an external periphery of the elongated body, the elongated body including a rear socket at the rearward portion configured for engagement with the barrel;

a central bore through the elongated body extending from the rearward portion to the forward portion and sized to receive a projectile fired from the barrel;

at least three slots formed radially from the central bore to the external periphery in the forward portion of the elongated body, the at least three slots including open forward ends and closed rearward ends thereby defining tines between adjacent slots;

wherein the forward portion of the elongated body portion is tapered such that an outer diameter of the elongated body portion decreases along the entire length of the tines from the closed rearward ends toward the open forward ends; and each slot having a transition portion extending from the central bore to the rearward end of each slot, wherein each of the transition portions is angled forwardly and defines a concave bottom profile.

2. The flash suppressor of claim 1, wherein the central bore defines a longitudinal axis of the elongated body and the transition portions are angled at about 45 degrees from the longitudinal axis.

3. The flash suppressor of claim 1, wherein the taper of the tines is angled inwardly at about 1 degree.

4. The flash suppressor of claim 1, wherein the tines include a longitudinal groove formed in the external periphery and wherein the groove extends along more than half the length of the tines.

5. The flash suppressor of claim 1, wherein the rear portion of the body defines a bearing surface along the external periphery, the bearing surface including an acme thread and an annular shoulder for direct coupling with a sound suppressor.

6. The flash suppressor of claim 5, wherein the acme thread includes a single lead.

7. The flash suppressor of claim 1, wherein the at least three slots consist of exactly three slots.

8. The flash suppressor of claim 1, wherein the rear socket includes internal threads for connection with the barrel and external flattened walls configured to engage with a wrench.

9. A flash suppressor for use with a firearm having a rifled barrel, the flash suppressor comprising:

an elongated body having a forward portion and a rearward portion, the rearward portion configured for engagement with the rifled barrel;

a central bore through the elongated body extending from the rearward portion to the forward portion, the central bore configured to allow a projectile fired from the rifled barrel to travel therethrough;

three slots formed radially from the central bore to an external periphery in the forward portion of the elongated body, the three slots including open forward ends and closed rearward ends thereby defining tines between adjacent slots; and wherein the forward portion of the elongated body portion is tapered such that an outer diameter of the elongated body portion decreases along the entire length of the tines from the closed rearward ends toward the open forward ends.

10. The flash suppressor of claim 9, wherein the rear portion of the body includes annular threads, wherein the threads have an outer diameter that is greater than an outer diameter of any other portion of the elongated body positioned forward of the threads.

11. The flash suppressor of claim 9, wherein the rear portion of the elongated body includes an annular shoulder for direct coupling with a sound suppressor, wherein the annular shoulder includes a plurality of angled teeth thereon.

* * * * *